United States Patent [19]

Hatte

[11] Patent Number: 4,580,839

[45] Date of Patent: Apr. 8, 1986

[54] CANE-BOTTOMED CHAIRS

[76] Inventor: Louis Hatte, l'Hotellerie, 53410 le Bourgneuf la Foret, France

[21] Appl. No.: 629,737

[22] Filed: Jul. 9, 1984

[51] Int. Cl.[4] ..... A47C 7/02

[52] U.S. Cl. ..... 297/452; 297/440; 297/445

[58] Field of Search ..... 297/452, 445, 440; 248/188, 188.1

[56] References Cited

U.S. PATENT DOCUMENTS

| | | | |
|---|---|---|---|
| 565,231 | 8/1896 | Ring | 297/452 |
| 719,837 | 2/1903 | Morton | 297/440 X |
| 1,848,656 | 3/1932 | Phenix | 297/452 |
| 2,864,438 | 12/1958 | Levine | 297/445 X |
| 3,556,594 | 1/1971 | Anderson | 297/452 |
| 4,225,181 | 9/1980 | Lock et al. | 297/440 |
| 4,348,053 | 9/1982 | Strassle | 297/445 |

*Primary Examiner*—James T. McCall
*Attorney, Agent, or Firm*—Young & Thompson

[57] ABSTRACT

The present invention concerns the cane-bottomed chairs so-called of the traditional type, i.e. without a belt made of slats surrounding the cane-bottomed seat portion. The chair according to the invention includes a rigid preassembled frame assembled with each of the four legs via a pin or tenon fitting, this frame being made of four traditional cane-bottoming crosspieces rigidly connected and kept in their relative positions by squaring elements while leaving free the end corner of the two crosspieces which meet for the housing of the leg section. The rigid preassembled frame can be cane before assembly with the legs.

7 Claims, 3 Drawing Figures

CANE-BOTTOMED CHAIRS

BACKGROUND OF THE INVENTION

There exist presently two main types of cane-bottomed chairs, viz. the chair with removable frame and the chair with fixed frame. The cane-bottomed chair of tradional character is a fixed frame chair in which the can-bottoming covers the front, rear and side crosspieces of the frame of the seat. In such a traditional chair, the legs are connected by four crosspieces including a pin at each of their ends, which pins fit into borings in the legs by forming therewith a fixed framing. In this embodiment, the caning operation has to be executed when the chair is assembled, thereby necessitating, when said caning operation is not performed on the spot, transportations of chair frameworks and finished chairs and, in all cases, a stock of chairs in all models marketed.

The chair with a removable frame remedies the two last mentioned disadvantages since the caning operation can be performed on the frame and the same frame can be adapted to several models of frameworks. However in the removable frame chair, the framework comprises a seat belt comprising four slats each pinned at both ends in the adjoining legs, which, with the frame having as such four joints, makes a total of twelve joints only for the seat portion of the chair. Due moreover to the outer slats forming the peripheral belt, the chair loses its traditional character.

OBJECT OF THE INVENTION

The object of the present invention is to provide a chair of traditional character that is without peripheral belt by using an independent frame adapted to be caned independently from the framework and which is incorporated in said framework via a reduced number of joints.

According to the invention, the frame is a rigid preassembled frame assembled with each of the four legs via a pin or tenon fitting, said frame being made of four traditional cane-bottoming crosspieces rigidly connected and kept in the relative positions by squaring elements while leaving free the end corner of the two crosspieces which meet for the housing of the leg section.

According to an embodiment, the fitting directions of the two pins or tenons of the rear corners and of the two pins or tenons of the front corners are perpendicular and, according to the preferred embodiment, the rear corner two pins or tenons fitting into the rear legs are directed transversely.

According to a further embodiment, the fitting directions of the four tenons or pins are parallel to each other, and according to the preferred embodiment, the fitting direction is the longitudinal direction.

The squaring elements of the frame connecting the four crosspieces could be screwed or fitted angle elements, whereby the projection of the elements on the inner face of the cane-bottoming crosspieces should not interfere with the cane-bottoming. In order to obtain a better rigidity, the crosspieces are preferably connected by a complete and rigid armouring frame. According to a preferred embodiment, the fixation of the crosspieces on the armouring frame is provided by fitting in a slot formed in the inner side of the crosspiece a wing of the armouring frame which protrudes laterally, the crosspieces being preferably kept each in position by at least a transverse spindle extending through holes in register in the slot wings and in the armouring frame wings. The armouring frame can be of any section and made of a flat section, a T-shaped angle bracket, etc. Where flat sections are used for the frame, their flat portions can be applied against the inner faces of the crosspieces and rigidly connected with said crosspieces by screws or spindles.

With the invention and due to the rigidity of the armouring frame, there is obtained a reinforcement of the squaring connections of the chair and a reduction of the risk for the side crosspiece to deflect from its position flush with the rear leg front. It is indeed this joint which is most subjected to stress when the chair is used, when the user leans against the back or sometimes rocks on the rear legs.

Moreover, the invention provides, with the appearance of a cane-bottomed chair of traditional character, the advantages of a removable frame, whereby the frame can be caned without the framework and be incorporated thereafter in frameworks of different models, thereby reducing the stock and storage volume. These advantages, in association with a limited number of joints allowing a gain of manufacturing time and a reduction of the frame cost, permit reducing the cost of the chair which is however of increased strength.

BRIEF DESCRIPTION OF DRAWINGS

The invention will be described in more detail with reference to the accompanying drawing wherein.

DETAILED DESCRIPTION OF INVENTION

Figure 1:
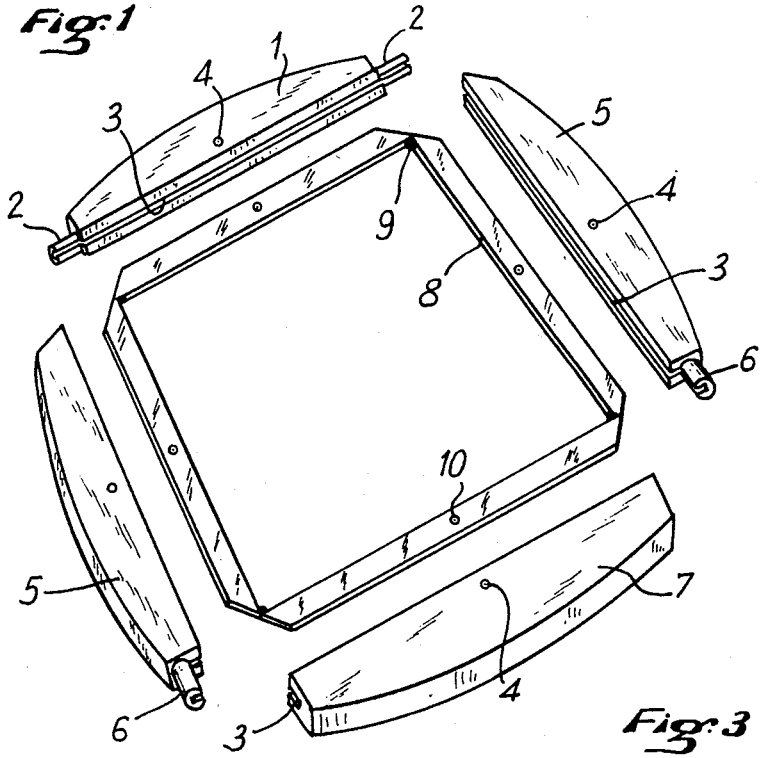
FIG. 1 is an exploded perspective view of the frame according to the invention.
Figure 3:
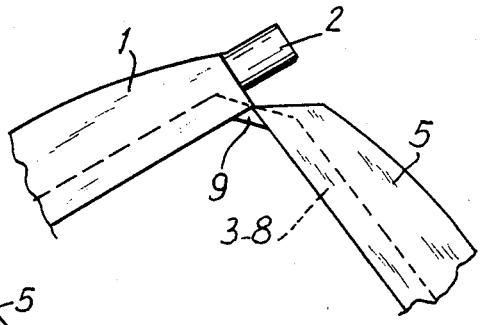
FIG. 2 is a perspective view of the frame when assembled and FIG. 3 is a detailed plan view of a corner of the frame.
Figure 2:
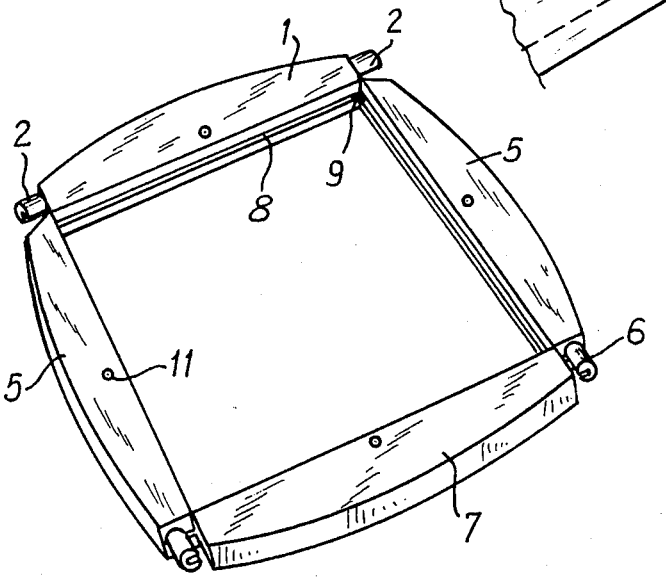

In the drawing, 1 designates the rear cane-bottoming crosspiece formed with two pins 2 protruding at both its ends and a slot 3 in its inner face, with a hole 4 extending perpendicularly through said slot. The two side cane-bottoming crosspieces 5 have only a single tenon 6 at their front end, but they include also a slot 3 on their inner face, formed with a hole 4 extending therethrough. The front cane-bottoming crosspiece 7 does not include tenons, but only a slot 3 with a through hole 4.

Reference 8 designates the armouring frame which, in the embodiment shown, is made of four lengths of flat irons connected by welds at 9, the frame edges being cut out so as to be clear from the fitting corners. The armouring frame could also be made of cast or bent metal and the section be formed, on all or part of the length of the sides, of a corner bracket, a T section, etc. Reference 10 designates borings formed in the wings of the reinforcement frame, borings which, during the assembly, come into register with the crosspiece holes 4.

After assembly with the crosspiece slots 3 fitted onto the wings of the armouring frame 8, the crosspieces are rigidly connected to the armouring frame by means of spindles, nails or screws 11 engaged in the holes 4 and 10 in register. The frame forms then a rigid unit which can be caned before assembling the chair by fitting the rear legs on tenons 2 and the front legs on tenons 6.

The invention solves the problem of a removable frame mounted according to the rigid frame system without necessitating machining operations, extra fittings or assemblies in the legs or between the cross-pieces forming it. The invention takes advantage of the rigidity of a squaring structure of small cross section which can be housed within the frame but which leaves free the space at the corners of the frame that is needed for the assembly of the chair legs.

I claim:

1. A chair bottom comprised by four separate elongated frame members, and a rigid open rectangular frame, one said frame member being secured to each side of said rectangular frame, the ends of the frame members being so disposed as to leave recesses at the four corners of the frame for the reception of a chair leg in each said recess, and a pin or tenon in each said recess for the securement of a chair leg in the said recess.

2. A chair bottom as claimed in claim 1, the pins or tenons extending from the ends of the frame members in the direction of the length of the frame members.

3. A chair bottom as claimed in claim 2, there being a said pin or tenon on each end of the frame member at the rear of the chair bottom and a single pin or tenon on each of the frame members at the left and right sides of the chair bottom at the forward side of the chair bottom.

4. A chair bottom as claimed in claim 1, and means detachably securing the frame members and rigid frame together.

5. A chair bottom as claimed in claim 4, there being holes through said frame members and said rigid frame which are in alignment with each other when said frame members are assembled on said rigid frame, and spindle means extending through the aligned holes.

6. A chair bottom as claimed in claim 1, said rigid frame being comprised by flat rigid elements secured together at their ends and disposed in a single plane, said frame members having grooves therein for the reception of a said flat element in each groove.

7. A chair bottom as claimed in claim 6, the corners of said rigid frame member being cut away so as to provide said recesses.

* * * * *